US005484361A

United States Patent [19]

Dunn

[11] Patent Number: 5,484,361

[45] Date of Patent: Jan. 16, 1996

[54] SPRING-LOADED SKI POLE FOR UPPER BODY WORKOUT

[76] Inventor: Rodney A. Dunn, 111 Sheldon St., Dowagiac, Mich. 49047-1350

[21] Appl. No.: 339,801

[22] Filed: Nov. 15, 1994

[51] Int. Cl.[6] ..... A63B 22/10

[52] U.S. Cl. ..... 482/51; 482/74; 482/109; 482/121; 482/126; 280/821

[58] Field of Search ..... 482/51, 74, 109, 482/121, 122, 126; 280/821, 819

[56] References Cited

U.S. PATENT DOCUMENTS 4,244,602 1/1981 Allsop et al. ..... 280/821

*Primary Examiner*—Lynne A. Reichard

[57] ABSTRACT

A new and improved spring-loaded ski pole for upper body workout comprising a base portion secured within a ski pole. The base portion has an aperture formed therethrough. Included in the device is a housing having an open first end and a closed second end. The open first end has a diameter greater than the base portion. The closed second end has an aperture formed therethrough. A steel rod is situated within the housing and retained within the aperture formed through the base portion. The steel rod has a stop integral therewith. The stop is positioned beyond the base portion preventing the steel rod from exiting the base portion. The second end extends upwardly through the aperture of the closed second end of the housing. A spring envelops the steel rod. The spring has a first end resting on the base portion and a second end resting against the closed second end of the housing. The spring allows the housing and steel rod to be moved downwardly relative to the ski pole and the base portion to a thrust position and then returned to a first position. A hand grip is coupled with the second end of the steel rod.

1 Claim, 4 Drawing Sheets

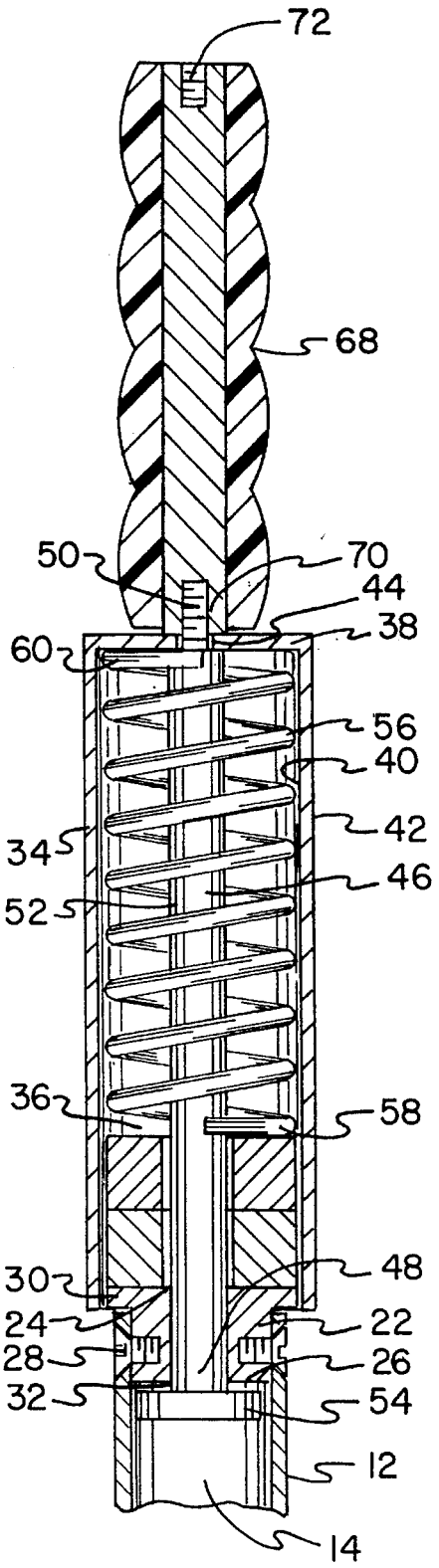
FIG. 7
FIG. 8
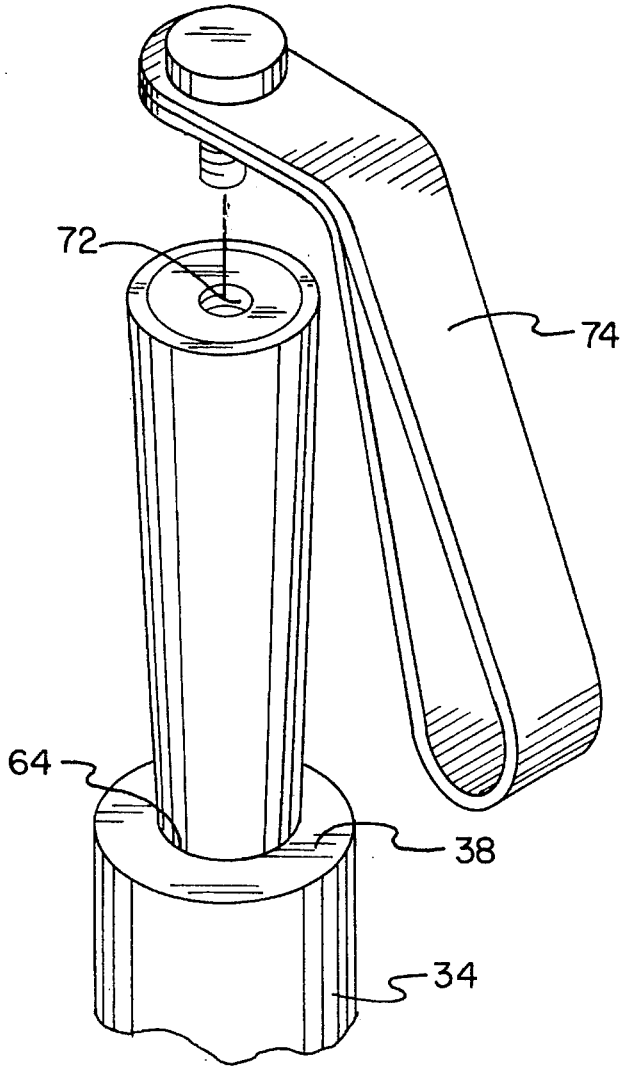

SPRING-LOADED SKI POLE FOR UPPER BODY WORKOUT

BACKGROUND OF THE INVENTION

1. Field of the Invention

The present invention relates to a spring-loaded ski pole for upper body workout and more particularly pertains to enabling a skier to obtain a better workout and adding impetus as the pole is released from snow with a spring-loaded ski pole for upper body workout.

2. Description of the Prior Art

The use of ski poles is known in the prior art. More specifically, ski poles heretofore devised and utilized for the purpose of aiding a skier are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,236,223 to Leon et al. discloses a ski pole for down hill or cross country skiing.

U.S. Pat. No. 5,139,284 to Ronning et al. discloses a ski pole composed of a shaft and a thinner ferrule part.

U.S. Pat. No. 5,114,186 to Sugiyama discloses a shock absorbing ski pole.

U.S. Pat. No. Des. 317,492 to Pugnat et al. discloses the ornamental design for a ski pole.

U.S. Pat. No. Des. 258,229 to Marker discloses the ornamental design for a ski pole.

While these devices fulfill their respective, particular objective and requirements, the aforementioned patents do not describe a spring-loaded ski pole for upper body workout for enabling a skier to obtain a better workout and adding impetus as the pole is released from snow.

In this respect, the spring-loaded ski pole for upper body workout according to the present invention substantially departs from the conventional concepts and designs of the prior art, and in doing so provides an apparatus primarily developed for the purpose of enabling a skier to obtain a better workout and adding impetus as the pole is released from snow.

Therefore, it can be appreciated that there exists a continuing need for new and improved spring-loaded ski pole for upper body workout which can be used for enabling a skier to obtain a better workout and adding impetus as the pole is released from snow. In this regard, the present invention substantially fulfills this need.

SUMMARY OF THE INVENTION

In the view of the foregoing disadvantages inherent in the known types of ski poles now present in the prior art, the present invention provides an improved spring-loaded ski pole for upper body workout. As such, the general purpose of the present invention, which will be described subsequently in greater detail, is to provide a new and improved spring-loaded ski pole for upper body workout and method which has all the advantages of the prior art and none of the disadvantages.

To attain this, the present invention essentially comprises a ski pole having an open first end, a second end, and an intermediate extent therebetween. The second end has a pointed tip. A circular basket is secured to the ski pole upwardly of the first end. The device contains a base portion having a first end and a second end. The second end is secured within the open first end of the ski pole by a pair of screws on either side thereof. The first end has an outwardly extending lip integral therewith. The outwardly extending lip extends beyond the diameter of the ski pole. The base portion has an aperture formed through the first end and the second end. The device contains a housing having an open first end, a closed second end, an inner surface, and an outer surface. The open first end has a diameter greater than the outwardly extending lip of the base portion. The closed second end has an aperture formed therethrough. The device contains a steel rod having a first end, a second end, and an intermediate extent therebetween. The steel rod is situated within the housing and retained within the aperture formed through the first end and the second end of the base portion. The first end has a stop integral therewith. The stop is positioned beyond the second end of the base portion preventing the steel rod from exiting the base portion. The second end is externally threaded. The second end extends upwardly through the aperture of the closed second end of the housing. The device contains a spring enveloping the intermediate extent of the steel rod. The spring has a first end resting on the first end of the base portion and a second end resting against the inner surface of the closed second end of the housing. The spring allows the housing and steel rod to be moved downwardly relative to the ski pole and the base portion to a thrust position and then returned to a first position. The device contains a hand grip having a first end, a second end, and an intermediate extent therebetween. The first end has an internally threaded aperture therein. The internally threaded aperture is coupled with the externally threaded second end of the steel rod. The second end has an aperture therein. A removable wrist strap is securable within the aperture of the second end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spring-loaded ski pole for upper body workout which has all the advantages of the prior art ski poles and none of the disadvantages.

It is another object of the present invention to provide a new and improved spring-loaded ski pole for upper body workout which may be easily and efficiently manufactured and marketed.

It is a further object of the present invention to provide a new and improved spring-loaded ski pole for upper body workout which is of durable and reliable construction.

An even further object of the present invention is to provide a new and improved spring-loaded ski pole for upper body workout which is susceptible of a low cost of manufacture with regard to both materials and labor, and which accordingly is then susceptible of low prices of sale to the consuming public, thereby making such a spring-loaded ski pole for upper body workout economically available to the buying public.

Still yet another object of the present invention is to provide a new and improved spring-loaded ski pole for upper body workout which provides in the apparatuses and methods of the prior art some of the advantages thereof, while simultaneously overcoming some of the disadvantages normally associated therewith.

Even still another object of the present invention is to provide a new and improved spring-loaded ski pole for upper body workout for enabling a skier to obtain a better workout and adding impetus as the pole is released from snow.

Lastly, it is an object of the present invention to provide a new and improved spring-loaded ski pole for upper body workout comprising a base portion secured within a ski pole. The base portion has an aperture formed therethrough. Included in the device is a housing having an open first end and a closed second end. The open first end has a diameter greater than the base portion. The closed second end has an aperture formed therethrough. A steel rod is situated within the housing and retained within the aperture formed through the base portion. The steel rod has a stop integral therewith. The stop is positioned beyond the base portion preventing the steel rod from exiting the base portion. The second end extends upwardly through the aperture of the closed second end of the housing. A spring envelops the steel rod. The spring has a first end resting on the base portion and a second end resting against the closed second end of the housing. The spring allows the housing and steel rod to be moved downwardly relative to the ski pole and the base portion to a thrust position and then returned to a first position. A hand grip is coupled with the second end of the steel rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a cross-sectional view as seen along line 6—6 of FIG. 5.

FIG. 8 is a front view of the detachable strap of the hand grip.

The same reference numerals refer to the same parts through the various Figures.

DESCRIPTION OF THE PREFERRED EMBODIMENT

Figure 1:
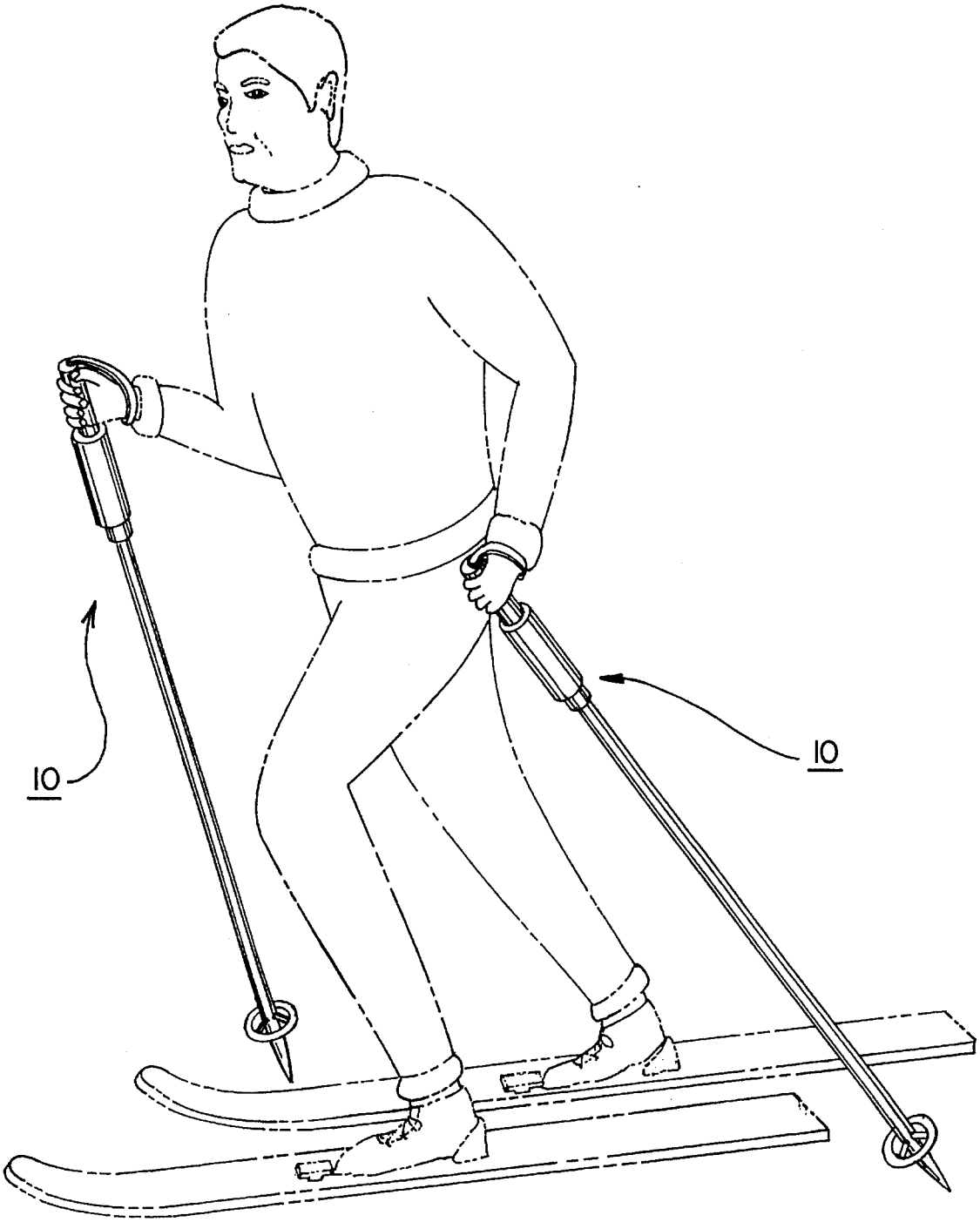
FIG. 1 is a perspective view of the preferred embodiment of the spring-loaded ski pole for upper body workout constructed in accordance with the principles of the present invention.
Figure 2:
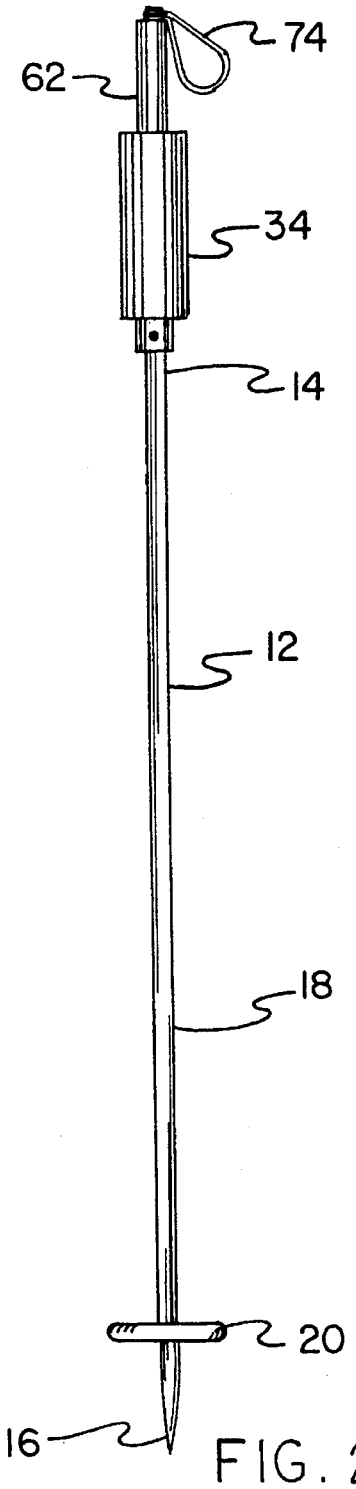
FIG. 2 is an elevated side view of the present invention.
Figure 3:
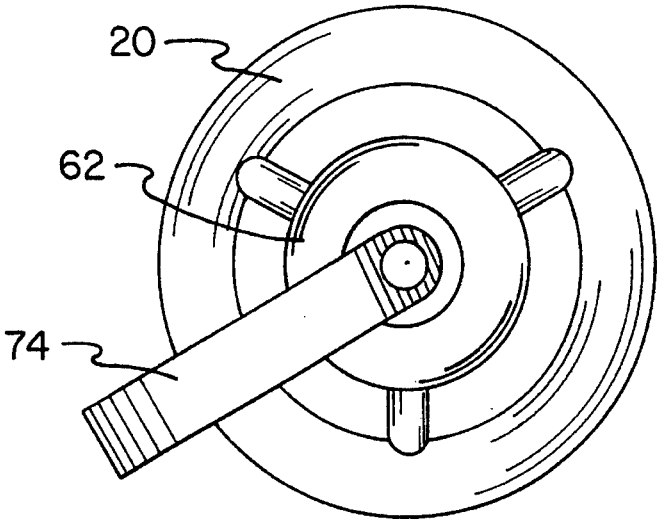
FIG. 3 is a plan view of the preferred embodiment of the present invention.
Figure 4:
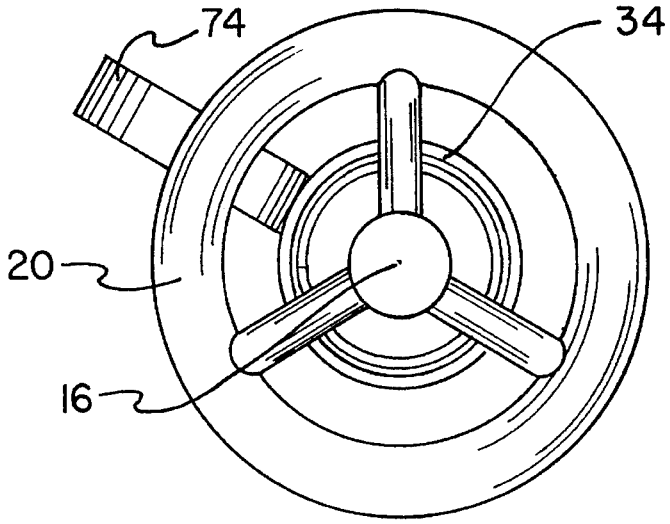
FIG. 4 is a bottom view of the preferred embodiment of the present invention.
Figure 5:
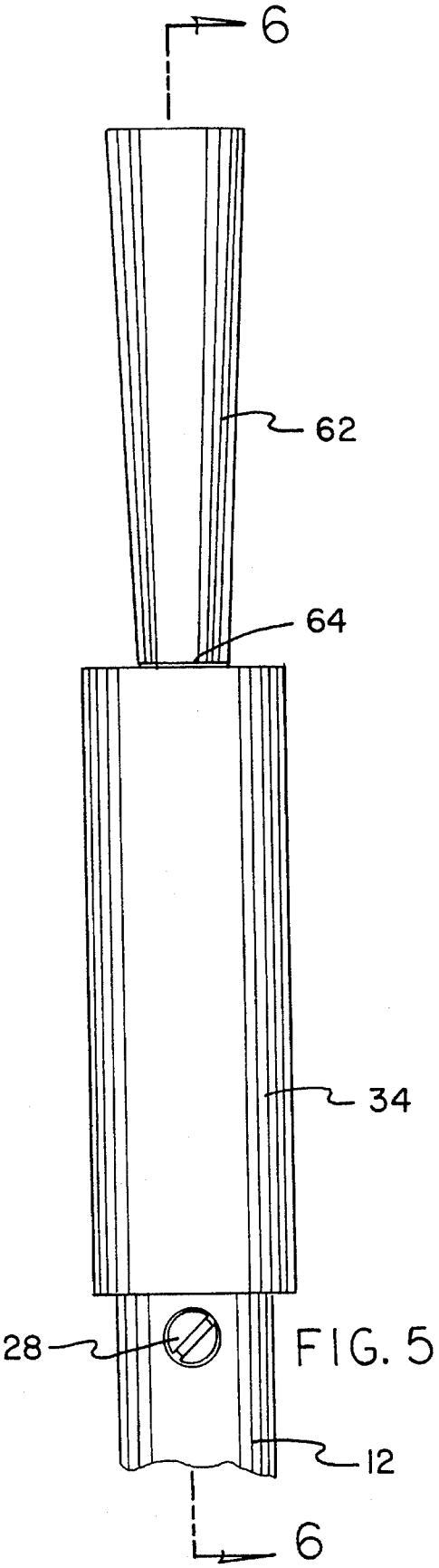
FIG. 5 is a partial elevated view of the housing and hand grip of the present invention.
Figure 6:
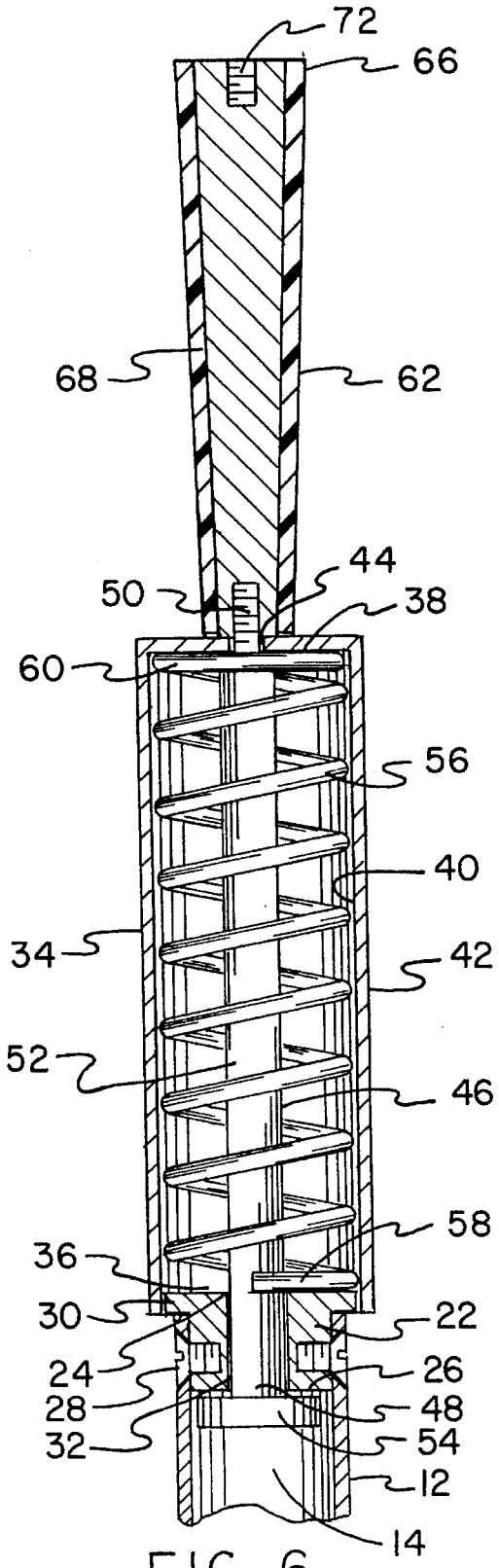
FIG. 6 is a cross-sectional view as seen along line 6—6 of FIG. 5.

With reference now to the drawings, and in particular, to FIG. 1 thereof, the preferred embodiment of the new and improved spring-loaded ski pole for upper body workout embodying the principles and concepts of the present invention and generally designated by the reference number 10 will be described.

Specifically, it will be noted in the various Figures that the device relates to a new and improved spring-loaded ski pole for upper body workout for enabling a skier to obtain a better workout and adding impetus as the pole is released from snow. In its broadest context, the device consists of a ski pole, a base portion, a housing, a steel rod, a spring, and a hand grip.

The device 10 contains a ski pole 12 having an open first end 14, a second end 16, and an intermediate extent 18 therebetween. The second end 16 has a pointed tip. The point allows the ski pole 12 to penetrate a snow or ice surface. A circular basket 20 is secured to the ski pole 12 upwardly of the first end 14. The basket 20 prevents the ski pole 12 from penetrating too far within the snow or ice. The ski pole 12 resembles a standard ski pole that is used in cross country skiing.

The device 10 contains a base portion 22 having a first end 24 and a second end 26. The second end 26 is secured within the open first end 14 of the ski pole 12 by a pair of screws 28 on either side thereof. The first end 24 has an outwardly extending lip 30 integral therewith. The outwardly extending lip 30 extends beyond the diameter of the ski pole 12. The base portion 22 has an aperture 32 formed through the first end 24 and the second end 26.

The device 10 contains a housing 34 having an open first end 36, a closed second end 38, an inner surface 40, and an outer surface 42. The open first end 36 has a diameter greater than the outwardly extending lip 30 of the base portion 22. The housing 34 is thereby capable of sliding past the outwardly extending lip 30. The closed second end 38 has an aperture 44 formed therethrough.

The device 10 contains a steel rod 46 having a first end 48, a second end 50, and an intermediate extent 52 therebetween. The steel rod 46 is situated within the housing 34 and retained within the aperture 32 formed through the first end 24 and the second end 26 of the base portion 22. The steel rod 46 slides freely within the aperture 32 of the base portion. The first end 48 has a stop 54 integral therewith. The stop 54 is positioned beyond the second end 26 of the base portion 22 preventing the steel rod 46 from exiting the base portion 22. The second end 50 is externally threaded. The second end 50 extends upwardly through the aperture 44 of the closed second end 38 of the housing 34.

The device 10 contains a spring 56 enveloping the intermediate extent 52 of the steel rod 46. The spring 56 has a first end 58 resting on the first end 24 of the base portion 22 and a second end 60 resting against the inner surface 40 of the closed second end 38 of the housing 34. The spring 56 allows the housing 34 and steel rod 46 to be moved downwardly relative to the ski pole 12 and the base portion 22 to a thrust position and then returned to a first position. The spring 56 provides the user with the exercise of the device 10. The device 10 allows the user to compress the spring 56 thereby requiring an extra muscle contraction of the upper arms to power the user while on their skis.

The device 10 contains a hand grip 62 having a first end 64, a second end 66, and an intermediate extent 68 therebetween. The first end 64 has an internally threaded aperture 70 therein. The internally threaded aperture 70 is coupled with the externally threaded second end 50 of the steel rod 46. The second end 66 has an aperture 72 therein. A removable wrist strap 74 is securable within the aperture 72 of the second end 66. The intermediate extent 68 of the hand grip 62 has a plurality of ridges thereon that allow the user to maintain a comfortable grip on the device 10.

The present invention is a ski pole 12 which is spring loaded, enabling the skier to obtain a better workout and add impetus as the pole 12 is released from the snow.

The spring housing 34 is located within, and just below, the area of the hand grip 62. The housing 34 consists of a base 22 which attaches to the ski pole 12 shaft with two screws 28, and through its axis is an aperture 32 which retains and guides a steel rod 46. At the bottom of this rod 46 is a mechanical stop 54 which limits its upward travel as it contacts the base 22, and the top of the rod 46 is threaded to facilitate the attachment of the hand grip 62. A spring 56 envelops the rod 46, with its bottom end resting on the base 22 and its upper end contacting the housing 34. The housing 34 is cylindrical and has an inside diameter slightly larger than the base plate, allowing it to pass over the base 22 during the compression stroke. The top of the housing 34 is enclosed, with a hole through its center for attachment to the rod 46, which is accomplished with hex nuts. A typical ski pole grip is pressed onto the hand grip 62.

When the pole is planted into the snow and drawn toward the body, the spring is compressed, giving additional resistance and exercise for the skier. As the forward lunge is made during the skiing stride, the spring adds thrust just prior to the pole being withdrawn from the snow, causing the skier to move forward more vigorously.

Cross country skiing is now recognized as one of the best forms of exercise. The addition of springs will increase the benefits derived from the activity.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spring-loaded ski pole for upper body workout for enabling a skier to obtain a better workout and adding impetus as the pole is released from snow comprising, in combination:

a ski pole having an open first end, a second end, and an intermediate extent therebetween, the second end having a pointed tip, a circular basket secured to the ski pole upwardly of the second end;

a base portion having a first end and a second end, the second end secured within the open first end of the ski pole by a pair of screws on either side thereof, the first end having an outwardly extending lip integral therewith, the outwardly extending lip extending beyond the diameter of the ski pole, the base portion having an aperture formed through the first end and the second end;

a housing having an open first end, a closed second end, an inner surface, and an outer surface, the open first end having a diameter greater than the outwardly extending lip of the base portion, the closed second end having an aperture formed therethrough;

a steel rod having a first end, a second end, and an intermediate extent therebetween, the steel rod situated within the housing and retained within the aperture formed through the first end and the second end of the base portion, the first end having a stop integral therewith, the stop positioned beyond the second end of the base portion preventing the steel rod from exiting the base portion, the second end being externally threaded, the second end extending upwardly through the aperture of the closed second end of the housing;

a spring enveloping the intermediate extent of the steel rod, the spring having a first end resting on the first end of the base portion and a second end resting against the inner surface of the closed second end of the housing, the spring allowing the housing and steel rod to be moved downwardly relative to the ski pole and the base portion to a thrust position, the spring then returns the housing and the steel rod to a beginning position;

a hand grip having a first end, a second end, and an intermediate extent therebetween, the first end having an internally threaded aperture therein, the internally threaded aperture couples with the externally threaded second end of the steel rod, the second end having an aperture therein, a removable wrist strap securable within the aperture of the second end.

* * * * *